US005406661A

United States Patent [19]

Pekar

[11] Patent Number: 5,406,661

[45] Date of Patent: Apr. 18, 1995

[54] PRELOADED FLUID BLADDER WITH INTEGRAL PUMP

[75] Inventor: Robert W. Pekar, Florence, Mass.

[73] Assignee: Reebok International Ltd., Stoughton, Mass.

[21] Appl. No.: 121,374

[22] Filed: Sep. 15, 1993

[51] Int. Cl.[6] ..... A47C 27/10; A43B 7/14

[52] U.S. Cl. ..... 5/454; 5/455; 5/457; 5/654; 36/29; 36/35 B; 36/153

[58] Field of Search ..... 5/449, 454, 455, 457, 5/654, 644; 36/29, 35 B, 153

[56] References Cited

U.S. PATENT DOCUMENTS

| | | | |
|---|---|---|---|
| 1,970,802 | 8/1934 | Johnson | 18/56 |
| 2,068,134 | 1/1937 | Houghton | 5/454 |
| 2,604,041 | 7/1952 | Reed | 5/455 |
| 2,817,088 | 12/1957 | Vrana | 2/18 |
| 2,881,445 | 4/1959 | Vrana | 2/18 |
| 3,332,415 | 7/1967 | Ericson | 128/87 |
| 3,583,008 | 6/1971 | Edwards | 5/454 |
| 3,638,253 | 2/1972 | Stumpf | 5/644 |
| 3,705,429 | 12/1972 | Nail | 5/349 |
| 4,247,963 | 2/1981 | Reddi | 5/644 X |
| 4,405,129 | 9/1983 | Stuckey | 5/654 X |
| 4,547,919 | 10/1985 | Wang | 5/455 |
| 4,724,560 | 2/1988 | Christie | 5/451 |
| 5,022,109 | 6/1991 | Pekar | 5/449 |
| 5,074,765 | 12/1991 | Pekar | 417/480 |
| 5,113,599 | 5/1992 | Cohen et al. | 36/88 |
| 5,144,708 | 9/1992 | Pekar | 5/454 |
| 5,158,767 | 10/1992 | Cohen et al. | 36/88 |
| 5,228,156 | 7/1993 | Wang | 36/35 B |

*Primary Examiner*—Michael F. Trettel

*Attorney, Agent, or Firm*—Sterne, Kessler, Goldstein & Fox

[57] ABSTRACT

A thermoplastic bladder and pump combination comprises three coextensive superposed layers of thermoplastic material peripherally sealed to one another to thereby form a bladder having upper and lower coextensive air chambers. The upper chamber is defined by the upper and intermediate layers and the lower chamber is defined by the intermediate and lower layers. The lower chamber is permanently inflated at the time of manufacture or assembly into a final product and the fluid pressure in the upper chamber can be modulated by the user who may alternately inflate and deflate the chamber by using an integral pump and release valve which are each disposed on the upper layer. The lower chamber may be filled using a thermoplastic intake check valve sealed between the layers defining that chamber and the superposed layers may be peripherally fused together, as by heat sealing or the like.

19 Claims, 1 Drawing Sheet

PRELOADED FLUID BLADDER WITH INTEGRAL PUMP

BACKGROUND OF THE INVENTION

1. Field of the Invention

This invention relates generally to inflatable bladders and more particularly, to such bladders which include a preinflated portion and a digitally operable pump integral with a separately inflatable portion for fully inflating the bladder at the user's discretion with but a few strokes of the integral pump.

2. Related Art

Many types of inflatable bladders are known in the prior art for use in a variety of applications. One type of such fluid bladder is disclosed in U.S. Pat. No. 5,113,599 (the '599 patent) which discloses an athletic shoe equipped with an inflatable bladder and which includes an integral pump for inflation of the bladder at the convenience of the user. Another athletic shoe equipped with an inflatable bladder is described in U.S. Pat. No. 5,158,767 (the '767 patent).

In addition, my prior U.S. Pat. No. 5,144,708 (the '708 patent) discloses an inflatable bladder having a digitally operable integral pump which allows use of the device in compact and portable applications such as athletic shoes, gloves and various orthopedic appliances such as back or lumbar support belts and the like. In using such devices, one can don the device while the bladder is in its deflated condition and then by inflating the bladder manually with the integral pump, achieve an appropriately snug fit for the particular purpose for which the device has been designed. These devices invariably utilize bladders having a single compartment which typically require numerous pump strokes to inflate the bladder completely.

While there are other types of inflatable bladders known in the prior art which include a plurality of separate compartments, such as those disclosed in U.S. Pat. Nos. 3,705,429 (the '429 patent) and 4,724,560 (the '560 patent), none of these patents teach the use of at least one compartment or chamber which is adapted to be permanently preinflated as at the assembly plant in combination with at least one other compartment or chamber that is selectively inflatable and deflatable at the user's convenience and to his or her own individual preferences. Indeed, the primary reason for utilizing such plurality of compartments in the above noted patent is simply to improve the support or comfort characteristics of the mattress, pillow, cushion or the like by properly locating the inflated air chambers for improved anatomical support.

While each of the above referenced prior art devices clearly provides certain benefits, none discloses a device which provides the combined benefits of a combination of preinflated chamber superimposed with a user inflatable chamber equipped with a compact, digitally operable pump integral therewith to enable the users of such devices to fully, quickly, and with only a few pump strokes, inflate the bladder to fit their own individual requirements.

SUMMARY OF THE INVENTION

It is a principal object of this invention to provide an inflatable bladder of such constructional characteristics as to overcome the shortcomings of the prior art.

It is another object of this invention to provide an improved bladder construction of the above type which is especially adapted for use in combination with a compact, digitally operable pump of small volume for rapid and easy inflation of the bladder.

It is a further object of this invention to provide a more reliable and easy to use bladder and pump combination for use in body support devices.

A still further object of this invention is to provide a novel method of manufacturing an inflatable bladder whereby the bladder is constructed with two separate chambers each with a separate check valve to enable partial preinflation at the manufacturing plant and which thereafter provides means enabling full inflation and deflation at the convenience and to the customer's individual preferences.

According to the invention, a fluid bladder comprises at least two outer layers and at least one intermediate thermoplastic layer peripherally sealed together to form at least two separately inflatable superimposed chambers. One of the chambers includes a combination pump and intake check valve and exhaust valve disposed on the upper layer thereof. Another fluid bladder includes a flexible intake check valve of the type adapted for more or less permanent inflation of the lower chamber of the bladder whereby the upper chamber can be alternately inflated and deflated by and to the individual user's requirements or preferences and the other chamber can be preinflated at the bladder's manufacturing or assembly plant so that the bladder can be fully inflated by the user with relatively few pump strokes of the integral digital pump.

The above and other objects and advantages of this invention will be more readily apparent from a reading of the following description of an exemplary embodiment thereof taken in conjunction with the following drawings.

BRIEF DESCRIPTION OF THE FIGURES

The accompanying drawings, which are incorporated in and form a part of the specification, illustrate an embodiment of the present invention and, together with the description, serve to explain the principles of the invention.

DETAILED DESCRIPTION OF THE PREFERRED EMBODIMENTS

Figure 1:
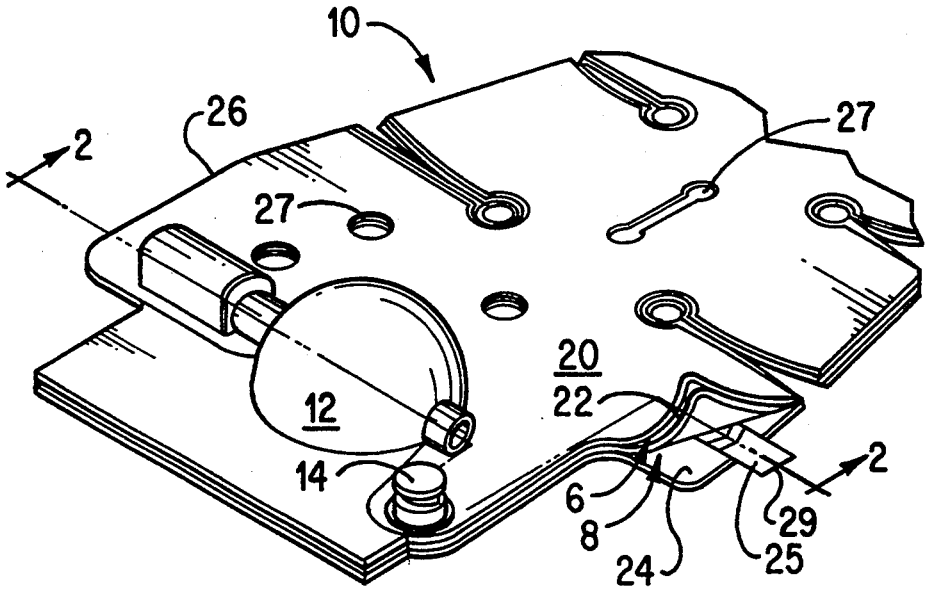
FIG. 1 is a perspective view of an elastomeric bladder and pump combination of the type embodying this invention with a corner opened up to reveal inner structure.

Referring to the accompanying drawings, wherein like numbers indicate like elements, in FIG. 1 is shown an inflatable thermoplastic bladder 10 of the type embodying this invention comprising an upper chamber 6, lower chamber 8, a valved pump 12 and a release valve 14. The pump 12 may be of a conventional digitally operable "bulb" type of relatively small displacement of approximately 3–5 cubic centimeters (cc) per stroke. Alternatively, the pump may be of the type disclosed in my '708 patent and the release valve may also be of the type disclosed in that patent, the disclosure of which is hereby incorporated by reference.

Figure 2:
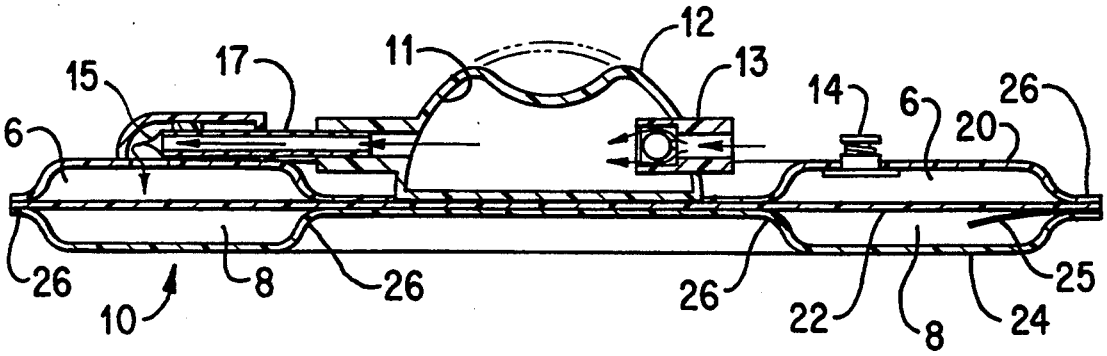
FIG. 2 is a cross-section taken along 2—2 of FIG. 1.

As best shown in FIG. 2, the pump 12, as illustrated, includes an intake valve 13 which may be of a conventional ball type valve and an output check valve 15 which may be of the duck bill type. When the outer wall of the pump 12 is pressed inwardly, as shown, air within the pump chamber 11 will be forced through the output valve 15 disposed on the outer end of tube 17 and into an upper chamber 6 of the bladder 10. When the semi-spherical outer wall of the pump 12 is released, because of its resilience, it will return to its original spherical shape, as shown in phantom in FIG. 2, resulting in a partial vacuum being formed in the pump chamber 11 so that air will be drawn into the pump through the one-way intake check valve 13.

As can be seen in FIGS. 1 and 2, the bladder 10 comprises three superposed layers, upper layer 20, intermediate layer 22 and lower layer 24. The upper and lower layers 20 and 24 may be a heat sealable, thermoplastic sheet material, such as polyurethane or polyvinylchloride which may range in thickness from about 0.005 to 0.050 inch. The intermediate layer, in stacked registry between the upper and lower layers, may also be a similar heat sealable, thermoplastic sheet material having a thickness of approximately 0.0015 inch. As shown, the pump 12 and release valve 14 are each integrally sealed, fused or bonded onto the upper layer 20 using conventional heat sealing, radio frequency (RF) energy, or other sealing method. An elastomeric, one-way intake check valve 25, preferably of the type disclosed in my '708 patent, is disposed between the intermediate and lower layers 22 and 24. The three layers 20, 22 and 24 are then heat sealed or otherwise fused together about their peripheries, as shown at 26, as well as at predetermined discrete locations disposed within their peripheries, based on the environment in which the bladder 10 is used, as shown at 27 in FIG. 1 to form a bladder having at least one discrete upper chamber 6 defined by upper and intermediate layers 20 and 22, at least one discrete lower chamber 8 defined by intermediate and lower layers 22 and 24 as best shown in FIG. 2. Simultaneously, check valve 25 is integrally formed with lower chamber 8.

Each weld location 27 completely fuses layers 20, 22 and 24 together to impart a similar quilting effect on both upper layer 20 and lower layer 24. However, in some cases a dissimilar quilting pattern may be desired between layers 20 and 24. Therefore, in an alternative embodiment, a barrier layer or release coating (not shown) may be disposed at certain weld locations between intermediate layer 22 and one of upper layer 20 and lower layer 24 where complete quilting of all three layers 20, 22 and 24 is not desired. The barrier layer prevents intermediate layer 22 from being fused with an adjacent layer between which the barrier layer has been applied. As a result, one of layers 20 and 24 will have less quilting than the other layer. The preferred barrier layer and methods of applying it are more fully described in U.S. Pat. No. 5,022,109 to Pekar, the disclosure of which is hereby incorporated in its entirety by reference.

A pump (e.g., an air pump) may be connected to the outer end 29 of the intake check valve 25 to preinflate the lower chamber 8 and may serve to maintain the lower chamber 8 in its further inflated condition indefinitely. Normally, a preinflatant such as a gas will be introduced into the lower chamber 8 at the manufacturing or assembly plant or at point-of-sale locations.

When a bladder embodying my invention is used in body support applications such as athletic shoes, the user may don the article (i.e., shoe, belt, etc.), and then utilize the digitally operable pump 12 to inflate the upper chamber 6 of the bladder 10 manually to achieve the requisite body supporting fit for engaging in the activity for which the particular product is designed. Because the lower chamber 8 has been preinflated and communicates pressure to adjacent upper chamber 6 through the common wall of intermediate layer 22, only the volume of upper chamber 6 need be manually inflated as opposed to the volume of the entire bladder 10. As a result, significantly fewer pump strokes are required before the bladder 10 is fully pressurized as compared to the number of pump strokes required to fully pressurize a conventional bladder using the small, compact digital pump of the type shown at 12 or as disclosed in my '708 patent. It is estimated that the number of pump strokes can be reduced by up to 50%. During breaks or after the activity has been completed, the user may wish to reduce the body support pressure and to do so, need only to activate release valve 14 to relieve the pressure in the upper chamber 6. This will enable the user to comfortably continue to wear the article during periods of less intensive activity. Because the device of this invention allows the user readily to control the bladder pressure, it is especially suitable for use in articles made for activities involving frequent transitions from relatively high to relatively low intensities. For example, runners engaging in fast sprints generally prefer to have their shoes laced very tightly and conversely, when engaged in warmups as by jogging, generally prefer a looser, more comfortable fit. Accordingly, using shoes equipped with the present invention, a runner engaging in "interval training" (periods of sprints followed by periods of jogging or walking) would either alternately tighten and loosen the laces of his running shoes at each interval, or be compelled to make an undesirable compromise whereby the shoes would be either too tight or too loose fifty percent of the time. A runner wearing shoes equipped with the present invention could, however, simply pump up the bladder 10 before each sprint and release some of the pressure therein during jogging periods. In this manner, the user could wear the shoes continuously without engaging in the task of alternately tying and untying the laces while at the same time maintain an optimum fit for each level of activity. Similarly, in downhill skiing, boots fitted with dual type bladders can be pumped up for the downhill runs and reduced in pressure when waiting in lift lines or riding the ski lift between skiing runs.

Similarly, a weight lifter, instead of either wearing a conventional lower back support belt continuously, or in the alternative, neglecting to wear any type of support belt, can use a lifting belt equipped with a bladder of the present invention. The user could then pump up the upper chamber 6 prior to lifting a heavy object, then immediately afterwards, release the pressure therein to leave the belt comfortably in place until ready to make another heavy lift.

Further, applications could include packaging or carrying cases for fragile articles, such as electronic devices including lap-top computers which are portable and moved from place to place more frequently than larger computers.

It should be understood that the upper and lower chambers need not be coextensive and that any suitable number of such chambers may be utilized while still being considered to be within the scope of this invention.

Furthermore, the use of an elastomeric intake check valve of the type as described at 25 for preinflated lower chamber 8 may not always be required since any means may be used for preinflating the chamber without departing from the scope of this invention.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

What is claimed is:

1. An inflatable bladder comprising:

a plurality of discrete chambers formed from upper, lower and intermediate layers peripherally sealed to one another;

a digitally operable pump, integral with one of said chambers to enable said one chamber to be selectively inflated at the user's discretion; and a one-way check valve integral with another of said chambers to enable said other chamber to be permanently preinflated by manually attaching thereto an air pump.

2. The bladder of claim 1, wherein said one chamber includes a release valve.

3. The bladder of claim 2, wherein said upper, lower and intermediate layers are formed from a thermoplastic material and wherein said intermediate layer is placed in stacked registry between said upper and said lower layers to form chambers substantially coextensive with each other.

4. The bladder of claim 3, wherein said upper, intermediate and lower layers are peripherally sealed to one another, said one chamber defined by said upper and intermediate layers and said other chamber defined by said intermediate and lower layers.

5. The bladder of claim 4, further comprising:

a discrete weld location disposed within said peripheral seal for fusing together said upper, intermediate and lower layers.

6. The bladder of claim 4, further comprising:

a plurality of discrete weld locations disposed within said peripheral seal for fusing together said upper, intermediate and lower layers.

7. The bladder of claim 3, wherein said digitally operable pump and said release valve are integral with said upper layer.

8. The bladder of claim 1, wherein said check valve is made from plastic material.

9. An inflatable bladder comprising:

superposed first, second and third layers of a plastic material;

a digitally operable pump integral with said first layer;

a seal disposed about the periphery of said first, second and third layers to peripherally seal them together to form a user-controlled inflatable chamber defined by said first and second layers and a preinflatable chamber defined by said second and third layers, said preinflatable chamber being permanently inflated; and said pump being operable to inflate said user-controlled chamber at a user's discretion.

10. An article of manufacture comprising:

a bladder having a plurality of discrete chambers formed by first, second, and third layers peripherally sealed to one another, one of said chambers being preinflated and communicating pressure to an adjacent chamber through a wall common to both chambers; and a user-controlled pump formed integrally with said adjacent chamber.

11. The article of claim 10, further comprising:

a discrete weld location disposed within said peripheral seal for fusing together said first, second and third layers.

12. The article of claim 10, further comprising a plurality of discrete weld locations disposed within said peripheral seal for fusing together said first, second and third layers.

13. An article according to claim 10, wherein said layers are made from thermoplastic material.

14. An article according to claim 10, further comprising:

a one-way check valve communicating with said preinflated chamber for introduction of a preinflatant.

15. An article according to claim 14, wherein an air pump introduces said preinflatant through said one-way check valve into said preinflated chamber.

16. An article according to claim 14, wherein said gas preinflatant is air.

17. An article according to claim 10, further comprising:

a release valve communicating with said adjacent chamber.

18. An article according to claim 10, wherein said release valve is formed integrally with said adjacent chamber.

19. An article according to claim 10, wherein said pump is digitally operated.

* * * * *